US005426899A

United States Patent [19]

Jones

[11] Patent Number: 5,426,899

[45] Date of Patent: Jun. 27, 1995

[54] SWIMMING POOL COVER

[76] Inventor: Betty M. R. Jones, P.O. Box 90, Madison, Ga. 30650

[21] Appl. No.: 203,267

[22] Filed: Feb. 28, 1994

Related U.S. Application Data

[63] Continuation-in-part of Ser. No. 767,091, Sep. 27, 1991, Pat. No. Des. 344,805.

[51] Int. Cl.[6] ..... E04H 15/18; E04H 15/34; E04B 1/19

[52] U.S. Cl. ..... 52/63; 52/222; 52/223.8; 4/498; 135/908

[58] Field of Search ..... 4/498, 503; 52/63, 83, 52/222; 135/101, 907, 908; 47/17

[56] References Cited

U.S. PATENT DOCUMENTS

| | | | |
|---|---|---|---|
| D. 266,534 | 10/1982 | Johanson | 25/15 |
| D. 327,744 | 7/1992 | Francis | 25/1 |
| D. 344,805 | 3/1994 | Jones | 25/2 |
| 3,143,122 | 8/1964 | Goodrich | 4/503 X |
| 3,424,179 | 1/1969 | Minot | 4/498 X |
| 3,510,996 | 5/1970 | Popil | 52/83 X |
| 3,611,649 | 10/1971 | Muller et al. | 52/222 X |
| 3,854,254 | 12/1974 | Janosko | 52/63 |
| 4,051,638 | 10/1977 | Heintz | 52/63 |
| 4,229,914 | 10/1980 | Lucas | 52/63 |
| 4,381,629 | 5/1983 | Ahn | 52/66 |
| 4,426,744 | 1/1984 | Love | 4/503 |
| 4,683,686 | 8/1987 | Ozdemir | 52/64 |
| 4,841,688 | 6/1989 | Rinaldi | 52/63 |
| 4,878,322 | 11/1989 | Ikeda et al. | 52/63 X |
| 4,901,484 | 2/1990 | Santosuosso | 52/90 |
| 4,924,651 | 5/1990 | Plant | 52/222 |
| 5,125,207 | 6/1992 | Strobl, Jr. | 52/747 |
| 5,210,983 | 5/1993 | Kolk | 52/63 |

*Primary Examiner*—Robert M. Fetsuga
*Attorney, Agent, or Firm*—Hopkins & Thomas

[57] ABSTRACT

A swimming pool cover (10) for enclosing a swimming pool or similar space. The cover (10) has a frame assembly (19), which generally is comprised of a plurality of opposed side support brackets (22) arranged in pairs on each side of pool (12), and a plurality of opposed end bracket assemblies (54) arranged in pairs along each end of pool. Support cables (64) extend across the pool, supported on each pair of side support bracket assemblies (22). A track assembly (20) is mounted on and supported by the support cables (64). A cover panel assembly (21) is mounted to the frame assembly (19) by the track assembly (20) and includes top cover panels (122), end cover panels (126), and corner panel assemblies (127), connected in series by the track assembly (20) for covering the top sides and ends of the pool.

14 Claims, 10 Drawing Sheets

21
71'
142
138
139
122
140
126
127
144
71
19
80
136
134
10

SWIMMING POOL COVER

CROSS-REFERENCE TO RELATED APPLICATION

This is a continuation-in-part of application Ser. No. 07/767,091 filed on Sep. 27, 1991, now U.S. Pat. No. D344,805.

FIELD OF THE INVENTION

This invention relates in general to a swimming pool cover. More particularly, this invention relates to a swimming pool cover which can be temporarily or permanently erected around the periphery of a space to be enclosed, for covering a space such as a pool or a garden.

BACKGROUND OF THE INVENTION

As Americans have become more health conscious, swimming for both recreational and exercise purposes has gained in popularity. A large number of swimming pools are, however, located outdoors, typically in the backyards of the pool owners' homes. The problem with such outdoor pools is that in most of the country the swimming season for outdoor pools is limited to the traditional warm weather months during the summer. As a result, with the onset of winter and colder temperatures, most outdoor pools become unusable and generally must be covered until it is again warm enough to swim. Also, as fall approaches, leaves and other debris can be blown into the pool with the result of fouling the pool's cleaning or filtering system, as well as leading to discoloration and impurities in the water of the pool. Outdoor pools also tend to attract both insects and wildlife to include frogs and snakes, which may seek to enter the pool for feeding or breeding purposes. Another disadvantage of an outdoor pool is that heavy rains increase the pool's water level, and can effect the PH balance of a pool necessitating the constant addition of treatment chemicals to bring the pool's PH levels to an acceptable standard.

Further, while outdoor pools allow the swimmers to enjoy the warmth of the sun, the problem also arises that the swimmers are exposed to potentially hazardous levels of ultraviolet radiation during prolonged periods of exposure to the sun. Recently, research has shown a high correlation between exposure to the sun's ultraviolet rays and the incidence of skin cancers. There is also the new concern that as the ozone levels in the atmosphere deteriorate, additional levels of ultraviolet radiation may pass through the atmosphere leading to increased sunburning, sun poisoning, and other ailments. Thus, persons with highly sensitive skin commonly enjoy limited use of outdoor pools.

Thus, a need exists for a swimming pool cover which can enclose to enable the pool to be utilized for a longer season than just during the warmer summer months and to protect swimmers from excess exposure to the sun's rays, and prevent debris, etc., from accumulating in the pool. Moreover, the need exists for a removable pool enclosure which can be used for other purposes if so needed in order to shelter space other than a pool. For example, the swimming pool cover can be used to shelter a garden, a storage area, or even a childrens' play area in order to maximize the owner's use of the swimming pool cover.

SUMMARY OF THE INVENTION

Briefly described, the present invention comprises a swimming pool cover for enclosing a pool or similar rectangular space such as a garden. The swimming pool cover generally is substantially rectangularly shaped and generally is sized so as to be larger than the area it is designed to cover, such as a typical outdoor residential pool. The swimming pool cover includes a top aligned approximately parallel to the space to be covered, longitudinal opposed first and second side surfaces opposed parallel ends and corner sections at the junction between the side surfaces and ends.

A plurality of support brackets are spaced along the sides and ends of the enclosure, adapted to be mounted along the periphery of the pool. The support brackets generally are formed from a resilient metal such as aluminum, with the support brackets on the first side of the enclosure having uniform height, and the support brackets on the second side of the pool having a uniform height that generally is greater than the height of the first side brackets. As a result, the cover of the pool enclosing the space is sloped upward from the first side of the pool toward the second side of the pool. A plurality of support cables are extended laterally across the pool supported by the support brackets. A removable cover is attached to and supported on the support cables for enclosing a top, sides, and ends of the pool. The support cables are attached at one of their ends to the support brackets on a first side of the pool, and are then stretched across the pool, supported on the brackets on the second side of the pool, and are then attached at their other ends to the brackets on the second side of the pool. As a result, the cables form a support for the cover for enclosing the pool over which the swimming pool cover is erected.

The cover comprises a series of top cover panels that extend from the first side across the pool to the second side forming the top and side surfaces of the cover, each panel corresponding to the spacing between the support brackets, and ends and corner panels. Each top cover panel typically is a substantially rectangularly shaped sheet having opposed side and end edges and is formed from a flexible watertight reinforced plastic material. Likewise, each end panel is substantially rectangular, and has an angled upper edge corresponding to the slope of the top surface of the cover and is formed from the same material as the top cover panels. Each corner panel generally is a substantially triangularly shaped sheet formed from the same material as the other panel sections. The cover panels are supported on the support cables in an interconnected relationship for enclosing the space over and around which the cover is installed. A plurality of elongated track members are received on and mounted to the cables. The track members generally are formed from an extruded plastic material, although other materials can be utilized as well, and are formed in sections adapted to longitudinally abut one another. The track members are configured to receive and hold the side edges of the cover panels, so as to connect the cover panels into a substantially continuous cover.

Therefore, it is an object of the present invention to provide a swimming pool cover for pools and gardens which can be installed quickly, easily, and inexpensively for temporary or permanent installation.

Another object of the present invention is to provide a swimming pool cover for a pool which will extend the time of the swimming season in which the pool can be used.

It is still another object of the present invention to provide a swimming pool cover which is less costly and easier to maintain than conventional inflatable enclosures requiring separate electrical motors and fans to keep the structure erect.

Another object of the present invention is to provide a swimming pool cover which allows continued use of a swimming pool while the enclosure is installed.

An additional object of the present invention is to provide a swimming pool cover that protects the space enclosed from leaves, branches, airborne debris, excess rainwater, and animals.

Another object of the present invention is to provide an apparatus which is simple in design and inexpensive to construct, is durable and rugged in structure, and can be easily fit or retrofit to new or existing applications.

Another object of this invention is to provide a pool cover having an attractive appearance.

These and other objects, features and advantages of the invention will become apparent upon reading the specification when taken into conjunction with the accompanying drawings, wherein like characters of reference designate corresponding parts throughout the several views.

DETAILED DESCRIPTION OF THE PREFERRED EMBODIMENT

Figure 1:
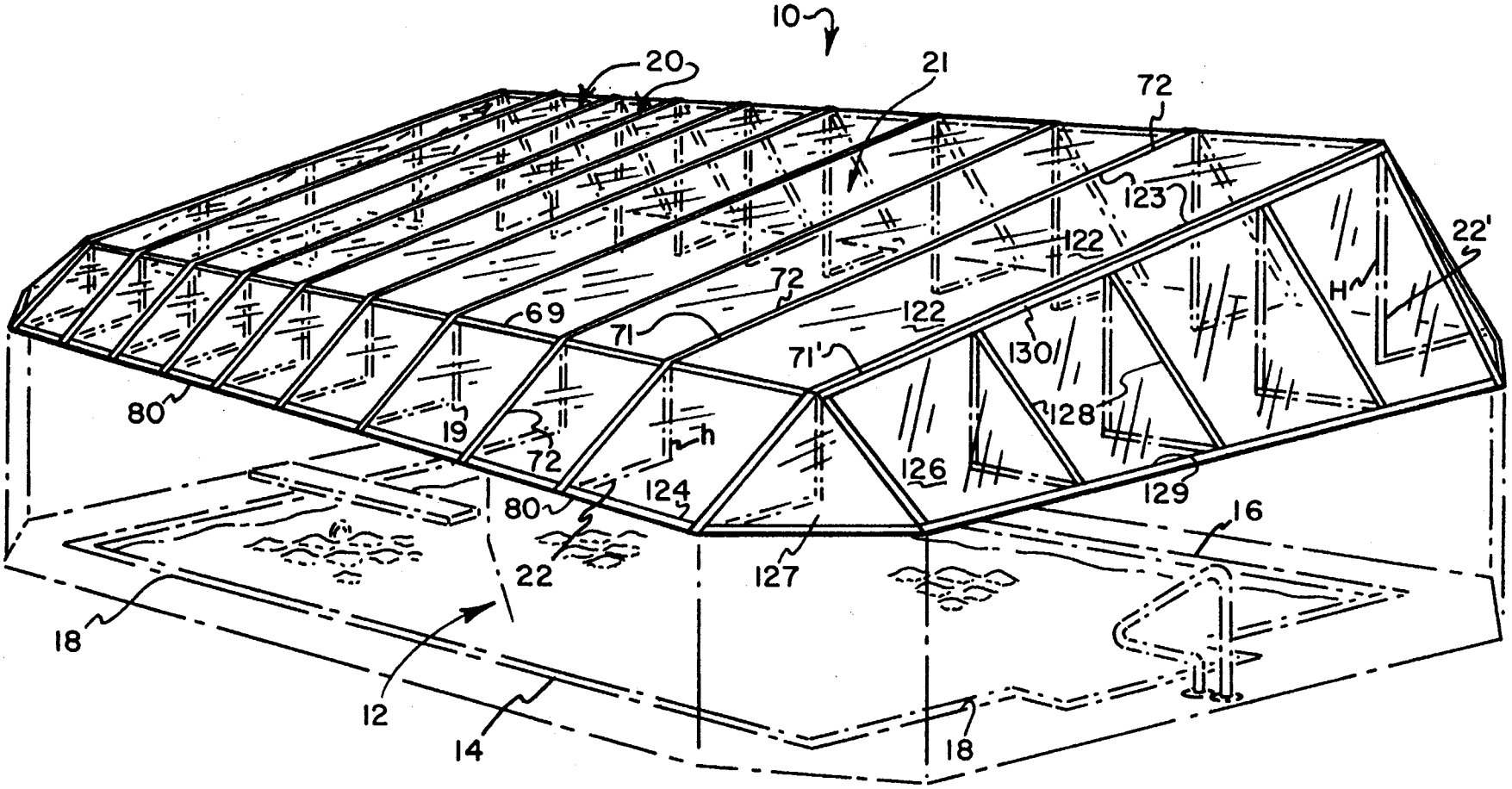
FIG. 1 is a perspective view of the swimming pool cover adapted to be mounted over a pool.

Referring now in more detail to the drawings, in which like reference numerals indicate like parts throughout the several views, numeral 10 in FIG. 1 illustrates a preferred embodiment of the swimming pool cover of the present invention. The swimming pool cover 10 is shown in FIG. 1 superimposed above an area, in this instance a swimming pool 12, having a longitudinal first side 14, and a parallel and opposed longitudinal second side 16. The pool 12 also has a pair of opposed parallel ends 18. First side 14, second side 16, and end 18 define the periphery of pool 12 to be enclosed by swimming pool cover 10. Although pool 12 is shown in FIG. 1 as a pool, it is understood by those skilled in the art that the area to be enclosed can be any generally rectangular area including a garden, a storage area for tools and equipment, and even a tent or emergency shelter.

Referring now to FIG. 1, swimming pool cover 10 includes a frame assembly 19, a track assembly 20, and a cover panel assembly 21 connected to one another forming an enclosure about the top, sides, and ends of the pool 12. Frame assembly 19 has a plurality of side support bracket assemblies 22 spaced along the length of both first and second side of the pool 12. Side support brackets 22 are arranged along the sides of the pool in pairs opposed to one another on opposite sides of the pool. Frame assembly 19 also has a plurality of end brackets 54 arranged in spaced pairs, opposed to one another along the end 18 of the pool 12. Each of side support brackets 22 positioned along the first side 14 of the pool 12 has a height denoted by "h". Each side support bracket 22' positioned along the second side 16 of the pool 12 has a height denoted by "H," which is greater than the height of side support brackets 22 on the first side 14 of the pool. Cover panel assembly 21 thus slopes downwardly from first side 14 toward second side 16 of the pool 12 as shown in FIG. 1. This will let rain and debris landing on the swimming pool cover fall off toward the lower first side of the pool.

Figures 2, 3:
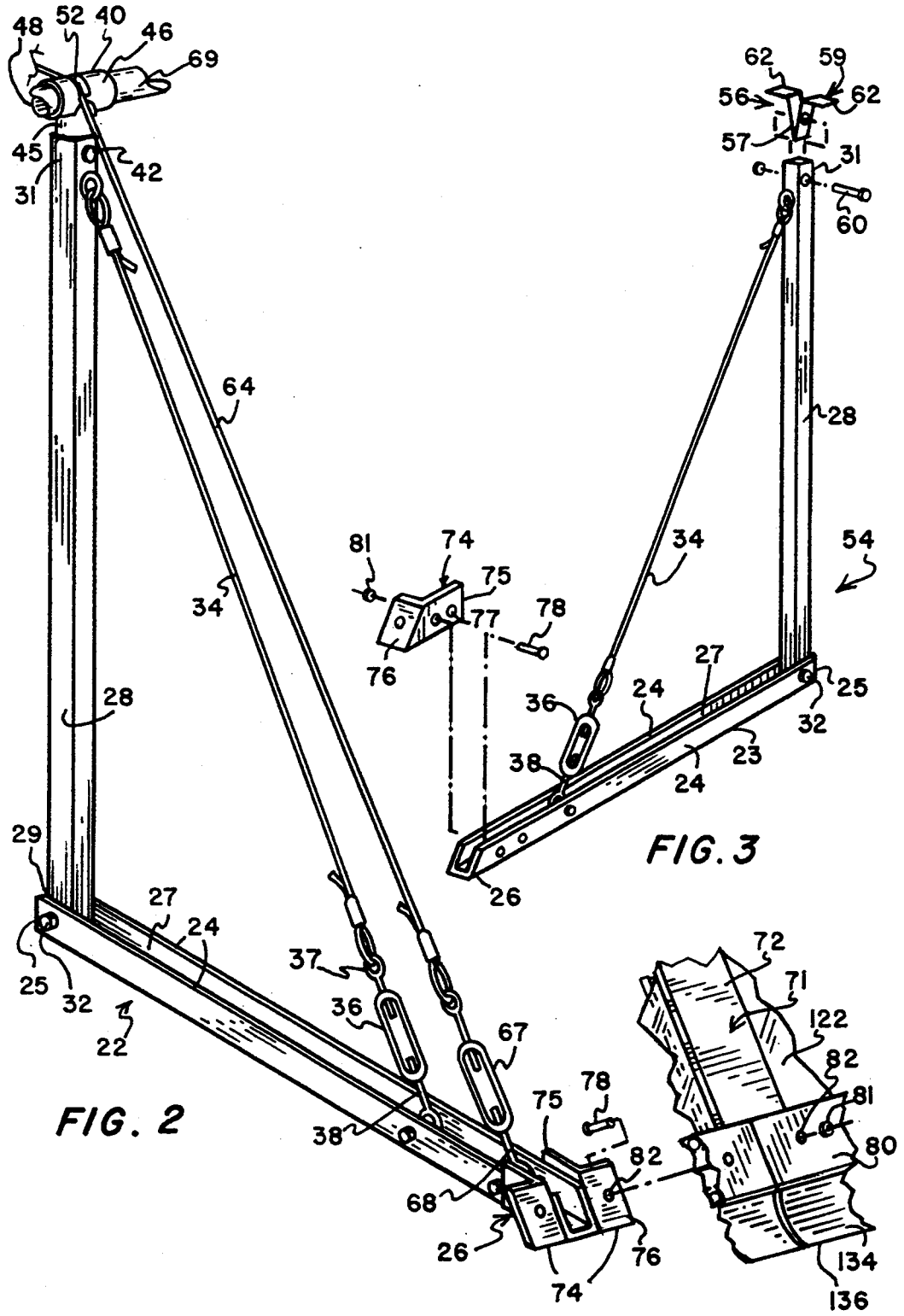
FIG. 2 is a partially exploded perspective view of a side support bracket assembly of the swimming pool cover's frame assembly.
FIG. 3 is a partially exploded perspective view of an end support bracket assembly of the swimming pool cover's frame assembly.

Referring now to FIG. 2, side support bracket assembly 22 has a U-shaped channel base member 23 having a first end 25 and a second end 26. Base member 23 includes a pair of upright channel walls 24 which define an open channel 27 and includes a series of pool bores (not shown) through which bolts or similar fasteners to secure the base member to a surface. An upright leg member 28 is received within the open channel and attaches to the first end 25 of the base member. Leg member 28 has a first end 29 that is pivotally connected to first end 25 of base member 23 by a bolt 32 or similar fastening means, and a second end 31 spaced from the first end 29. This pivotal connection enables the leg member 28 to fold into base member 23 for storage. Each of U-channel base member 23 of side support bracket assemblies 22 and end bracket assemblies 54, is bolted or spiked to the foundation or into the soil surrounding pool 12. Bolts 33 are passed through the bores opening (not illustrated) formed through the bottom of base member 23 into the foundation surrounding the pool.

In the event there is no foundation surrounding the pool, or when used as a tent or shelter, a strap (not shown) is placed across each of the base members, overlapping the sides of the base members. Elongated spikes are inserted through openings in the straps on both sides of the base members for securing base members in position.

A guy wire 34 is connected to the second end 31 of leg member 28 and to the base member 3 adjacent second end 26 thereof for the purpose of adding structural rigidity to angle bracket assembly 22. Guy wire 34 is connected to the base member by a jaw and eye turnbuckle 36 which enables the guy wire to be drawn through an eye 37 and is attached to the channel walls 24 of base member 23 by a jaw 38.

As illustrated in FIG. 2, each side support bracket 22 also has a T-section 40 connected at the second end 31 of each leg member 28 by a bolt 42. The T-section generally is formed from polyvinylchloride (PVC) and has a first section 45 (FIG. 4) which is connected inside of second end 31 to leg member 38, and a second section of T-section 46 is formed as an elongated section oriented perpendicularly to support cable 64 of frame assembly 19. An elongated hollow circular passage 48 is defined within the second section of T-section 46 and passes therethrough along its longitudinal axis. Housed within second section 46 of T-section 44 is a cable support roller 50, which is itself a hollow tube section held concentrically about the periphery of circular passage 48 in second section 46. Support cable roller 50 generally is constructed of aluminum or similar material and rotates freely within the second section 46 of T-section 40. A slot 52 is defined within the exterior of second section 46, and is adapted to receive a support cable 64 therein so that the cable is supported and rides on support cable roller 50.

End bracket assemblies 54 of frame assembly 19 are best shown in FIG. 3. Each end bracket assembly 54 is substantially identical in construction to side support bracket assemblies 22 except that each end bracket has a connector 56 that is received within and mounts to the second end 31 of leg member 28, rather than a T-section 40 as used with each side support bracket assembly 22. The connector 56 has a V-shaped lower portion 57 which is received within and is bolted to a second end 31 of leg member 28 by bolt 60 or similar fastener. The connector also has an upper portion 59 formed from a pair of diverging co-planar surfaces 62 extending perpendicular to leg member 28 of end bracket assembly 54.

The components of side support bracket assembly 22 and end bracket assembly 54 are generally constructed of aluminum in order to provide the advantages of being lightweight and having corrosion resistance against outdoor and marine environments although other lightweight resilient materials can be utilized as desired. T-section 40 generally is constructed of a plastic such as PVC, or a similar material, and connector 56 of end bracket 54 is constructed of aluminum.

Referring now to FIGS. 2 and 3, it is anticipated that each leg member 28 of each side support bracket assembly 22 and end bracket assembly 54 also can be constructed with a telescoping section 37 formed therealong. With such a construction, each of the legs 28 could be telescoped upwardly or downwardly so that the cover can be elevated as desired. Configured in this manner, swimming pool cover 10 could function as a tent, a shelter, greenhouse, or an awning for camping or picnicking purposes, as well as for other family activities.

As illustrated in FIG. 2, a support cable 64 is also provided as a part of frame assembly 20. Support cable 64 generally is constructed of plastic enclosed wire rope. Each end of support cable 64 is fastened to the second ends 26 of the base members 23 of each pair of opposed side support brackets 22 (as illustrated generally in FIGS. 1 and 5), such that support cable 64 extends from second end 26 of base member 23 mounted along first side 14 of pool 12 toward and on T-section 40 of the side support bracket, passing through slot 52 and riding on support cable roller 50 (FIG. 4), and extends laterally across pool 12 or other space and is received in slot 52 and on upper cable roller 50 of an opposed T-section 40 on a second side support bracket assembly 22 on the second side 16 of pool 12. A jaw and eye turnbuckle 67 is provided-at each end of support cable 64, turnbuckle 67 being attached to second end 26 of base member 23 jaw, in fashion similar to jaw and eye turnbuckle 36 of guy wire 34.

Figure 4:
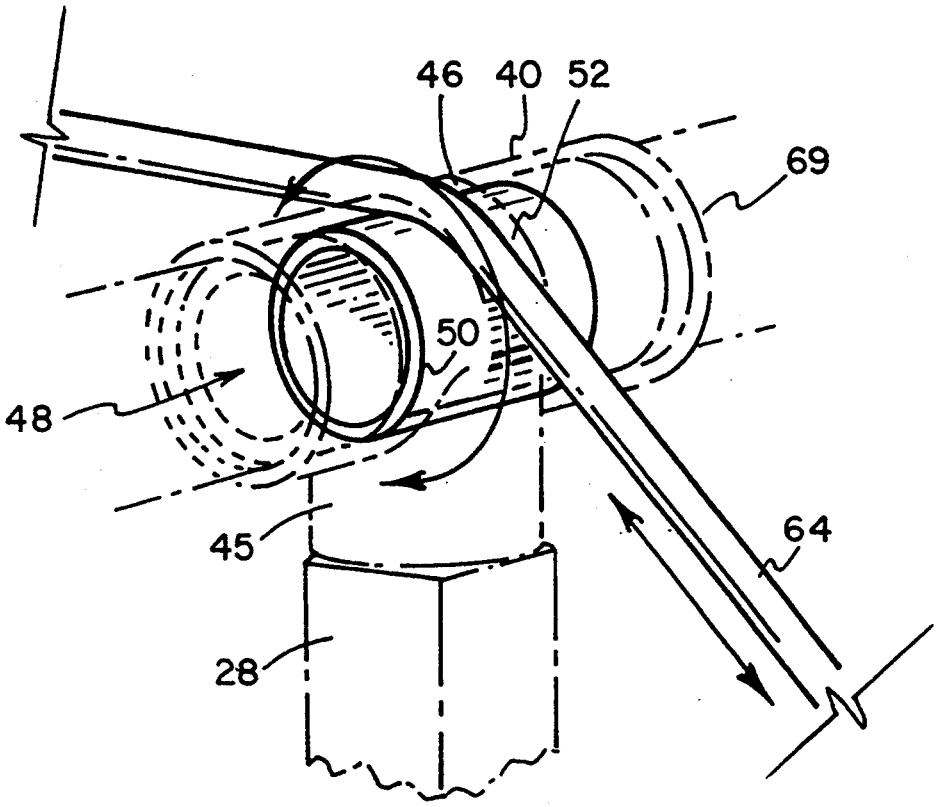
FIG. 4 is a perspective view of the T-section cable support of the side support bracket assembly illustrated in FIG. 2.
Figure 12:
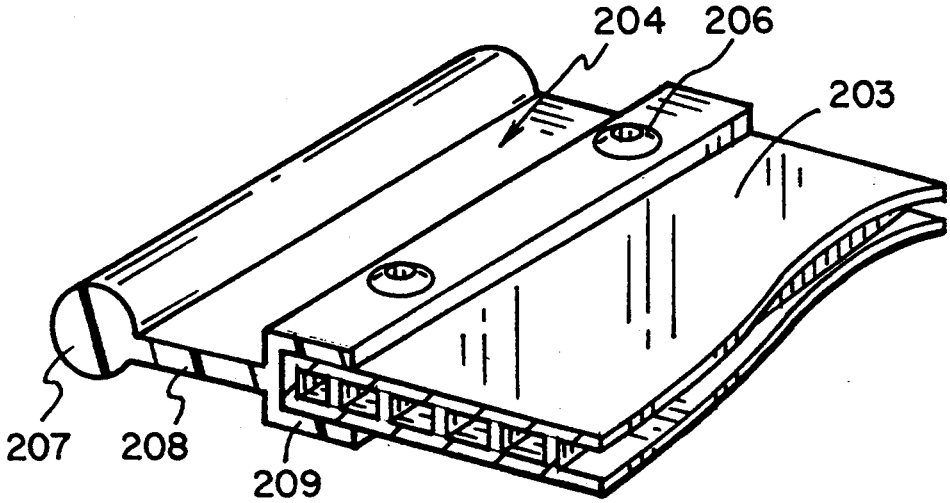
FIG. 12 is a perspective view of an alternate embodiment of the attachment of the cover panel to an extruded shape.

Each side support bracket assembly 22 is connected to the next side support bracket along each side of pool 12 by an elongated cylindrical tube 69. The tubes 69 are partially inserted through the hollow circular passages 48 defined in ends 46 of T-section 40 (FIG. 4). Tube 69 generally is formed from aluminum or a similar material encased in a PVC sleeve that rotates about the tube 69. The tube is provided for the purpose of structurally unifying the side support bracket assemblies 22 on first side 14 and second side 16 with one another and with end support brackets 54 to provide a strong, rigid frame assembly 11 for pool covers.

Figure 5:
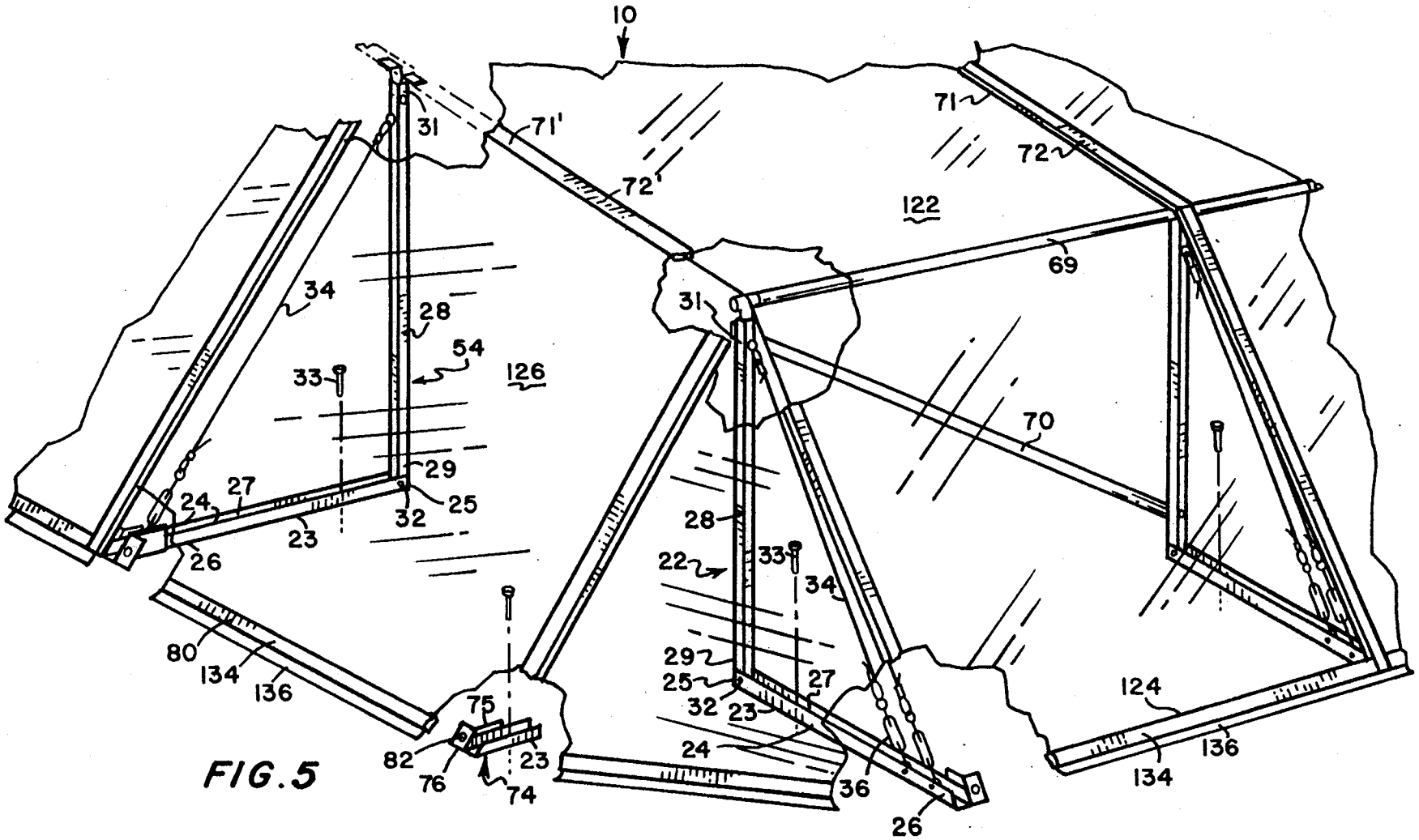
FIG. 5 is a partially cutaway perspective view illustrating the mounting of a portion of the swimming pool cover's frame to a surface.

As shown in FIG. 5, bracing angles 70 are attached to the first two side support bracket assemblies at each corner of the frame assembly. The bracing angles 70 generally are rigid straps formed from aluminum and provide support for the side support brackets at the corners.

As shown in FIG. 5, track assembly 20 has a series of sections 71 each approximately 2–5 feet in length, although other lengths can be used depending on the size of the pool to be covered, and typically formed from an extruded plastic material such as PVC. A series of top track members 72 are mounted on the support cables 64 in end-to-end abutment across the width of the pool in series extending from the first side of the frame assembly 19 across the width of the pool and down the second side of the frame assembly as shown in FIG.

As shown in both FIGS. 1, 2, and 5, foot brackets 74 are mounted to the second ends 26 of the base members 23 of the side support and end bracket assemblies 22 and 54. Each foot bracket 74 is a substantially L-shaped member having a longitudinal portion 75 that extends parallel to the side walls 24 of the base members and a sloped lateral portion 76 extending perpendicular thereto. Bores 77 are formed in the longitudinal portions 75 through which bolts 78 are inserted to attach the foot brackets to the side walls of the base members. Track assembly also has a plurality of bottom track members 80, each bottom track member extending between and connecting each side support bracket assembly to the other by the insertion of bolts 81 through bores 82 formed in sloped portions 76 of foot brackets 74.

Each top and bottom track member 72 and 80 has the same construction and each includes a top plate 90 and a bottom plate 91 and has a series of downwardly extending ribs 92, 93, 94, and 95 formed along the length of its lower surface, which are extended downwardly toward and opposed to a series of upwardly extending ribs 96, 97, 98, and 99 formed along the length of bottom plate 91. A slotted opening 100 is defined between each pair of ribs 92 and 96 and 95 and 99, along the entire length of each exterior side of each track member (FIG. 6).

A web 101 is formed approximately centrally between the top and bottom plates 90 and 91 and connects the two plates in a spaced overlying relationship. Pairs of longitudinally extending and parallel passages 102 and 102' thus are formed within each track assembly member. A second slotted opening 103 is defined between the pairs of ribs defining the two outermost and two innermost hollow passages 102 and 102'. As shown in FIG. 6, a pair of substantially "E" shaped legs 104 and 105 project downwardly from the bottom plate, away from the top plate and an arcuate section 106 is formed in the bottom plate 91 at the web 101, forming the roof of a cable receiving passage 107 defined within and extending along the longitudinal axis of each track member.

Support cable 64 is received within cable passage 107, and is retained in position by a cable retaining plate 108 held in a slot 109 formed in the gap between top flange 110 and bottom flange 112 of each leg 104 and 105. Each cable retaining plate is a rectangularly shaped plate of a length approximately equal to the length of each track member in which it is inserted. After support cable 64 has been placed within cable receiving passage 107, cable retaining plate 108 is inserted at one end of the track member and is slid along the length of slot 109 to secure the track member to its support cable 64.

Figure 6:
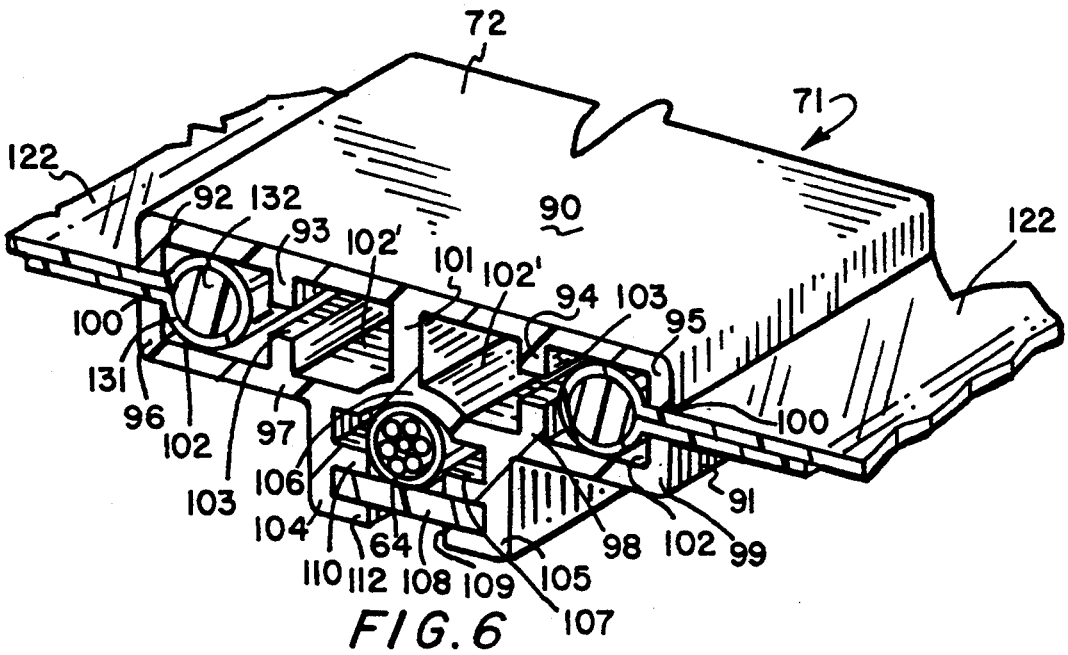
FIG. 6 is a perspective view of a track member shown in cross-section, which illustrates the connection of the track members to the support cables and the cover panels to the track members.
Figure 7:
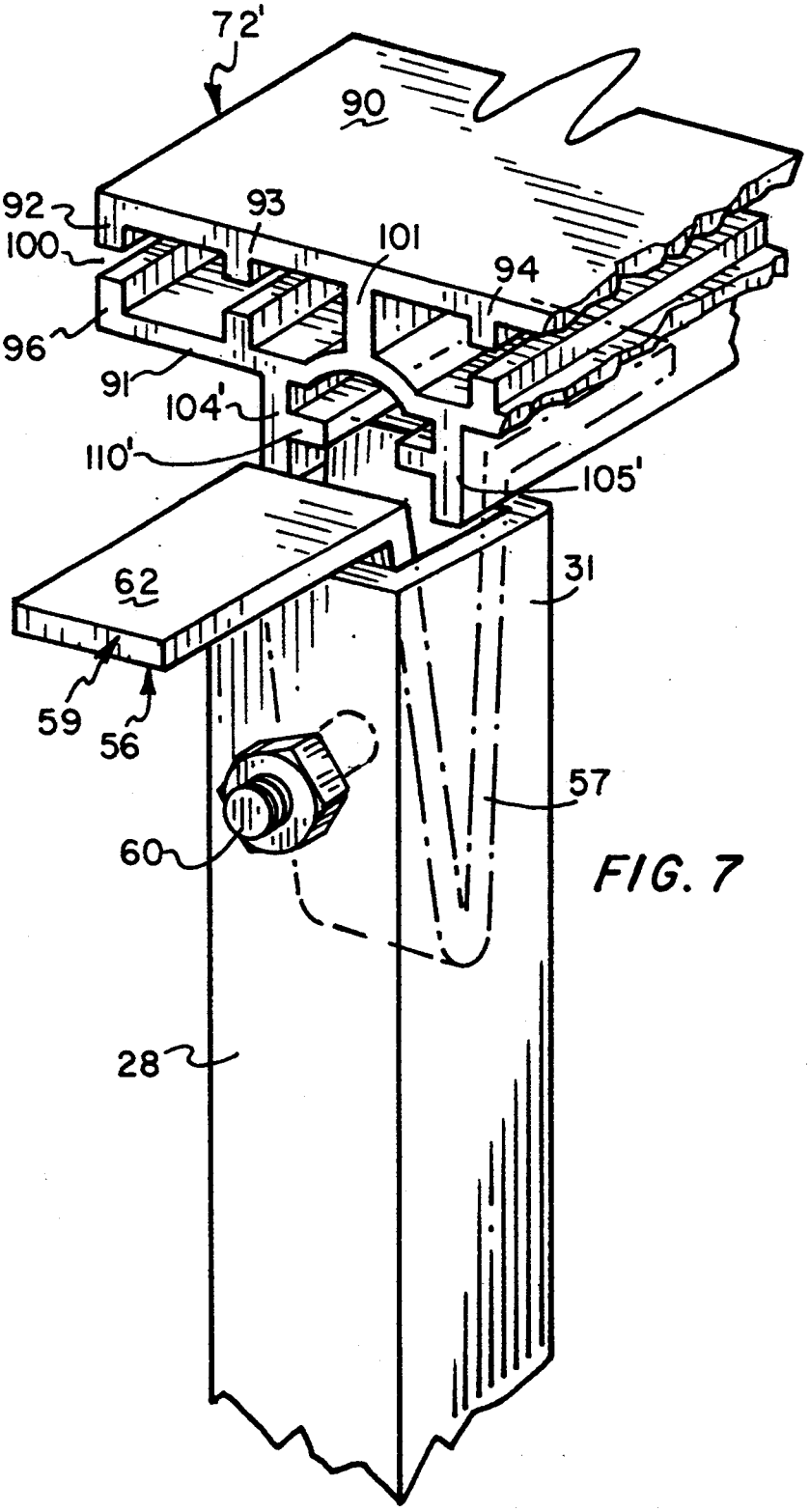
FIG. 7 is a perspective view of the end track connector forming a part of the end support bracket assembly illustrated in FIG. 3, shown in partial cross-section, and showing an end track member of the swimming pool cover's frame.

As shown in FIG. 7, the track members 72' mounted along the top of the end bracket assemblies 54 at each end of frame assembly 19 (FIG. 5) have a substantially similar construction to that of track sections 71 shown in FIG. 6, with the exception that a portion of bottom flanges of legs 104' and 105' are partially cutaway, and instead top flanges 110' rest upon each respective planar surface 62 of connector 56 of each end bracket assembly 54. Additionally, the cable retaining plates to be used along the end track members 72' are of a slightly shorter length than the end track members to accommodate the engagement of the connector 56 by the end track members. Each track member can be cut to different lengths of the same extruded shape in order to simplify the costs of manufacturing track assembly for swimming pool cover 10. Referring now to FIG. 1, cover panel assembly 21 is illustrated. Cover panel assembly 21 is comprised of a plurality of top cover panels 122, end cover panels 126, and corner cover panel assemblies 127. Each top cover panel 122 typically is substantially rectangularly shaped and has elongated parallel side portions 123 and opposed end portions 124. Each of end cover panels 126 is similarly constructed, having elongated parallel sides 128, a lower edge 129, and an upper edge 130. The upper edges 130 of the end cover panels are sloped from the first side of the pool cover 10 toward second side thereof so that each of end cover panels 126 generally has a trapezoidal shape. Each of the top and end cover panels 122 and 126 generally is formed of a durable flexible weathertight plastic such as a (polyester) polycarbonate sheeting, reinforced, or similar material. Although it is not illustrated, it is also anticipated that each of the cover panels also could be constructed of a plastic mesh or screen so that swimming pool cover 10 would function as a screen enclosure for enclosing a pool in order to keep insects, birds, wildlife, and debris outside of the space to be enclosed. This construction of swimming pool cover 10 would be particularly well suited to enclose swimming pools and as a fence to keep children out of a pool area.

As illustrated in FIG. 6, in a first embodiment each cover panel 122,126, and 127 will have an elongated pocket 131 formed along each side and end of the cover panel. Once the pocket has been formed, either by forming the pocket and gluing the cover panel to form the shape, or sewing the shape into the cover panel, a tube or rod 132 is placed through the pocket in order to create the means for connecting each of the cover panels to each of the track members. The rod 132 generally is formed from a flexible material such as PVC. This is illustrated in FIG. 6 where it is shown that an elongated tube 132 has been placed in pocket 131 of a top cover panel 122, and the cover panel has been received through slotted opening 100 or 103 of a track section 71 so that tube 132 is received within and extends along one of the passages 102 and 102' formed within the track member. Although it is not specifically illustrated here, each of the track assembly members is constructed so that it will secure the top and end cover panels, respectively, to each respective top, and bottom track member, respectively. In an alternate embodiment for each of cover panels 122, 126, and 127, the cover panels can be heat sealed or otherwise attached to a welting strip having a connecting member formed as a part thereof.

Figure 6A:
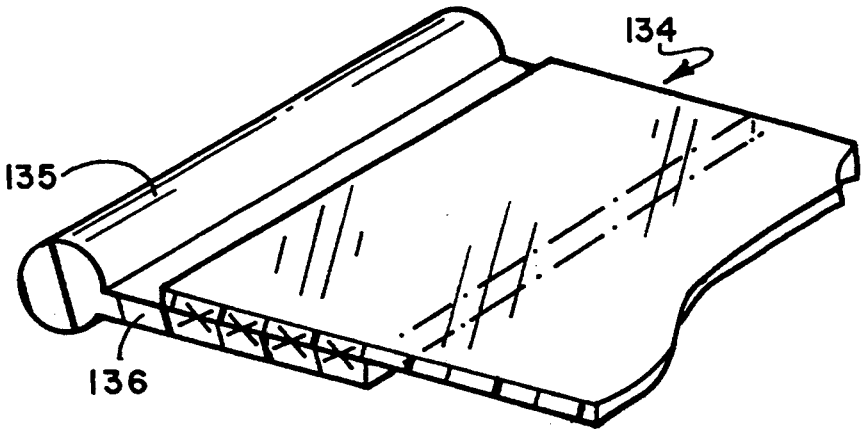
FIG. 6A is a perspective view of a welting strip.
Figure 8:
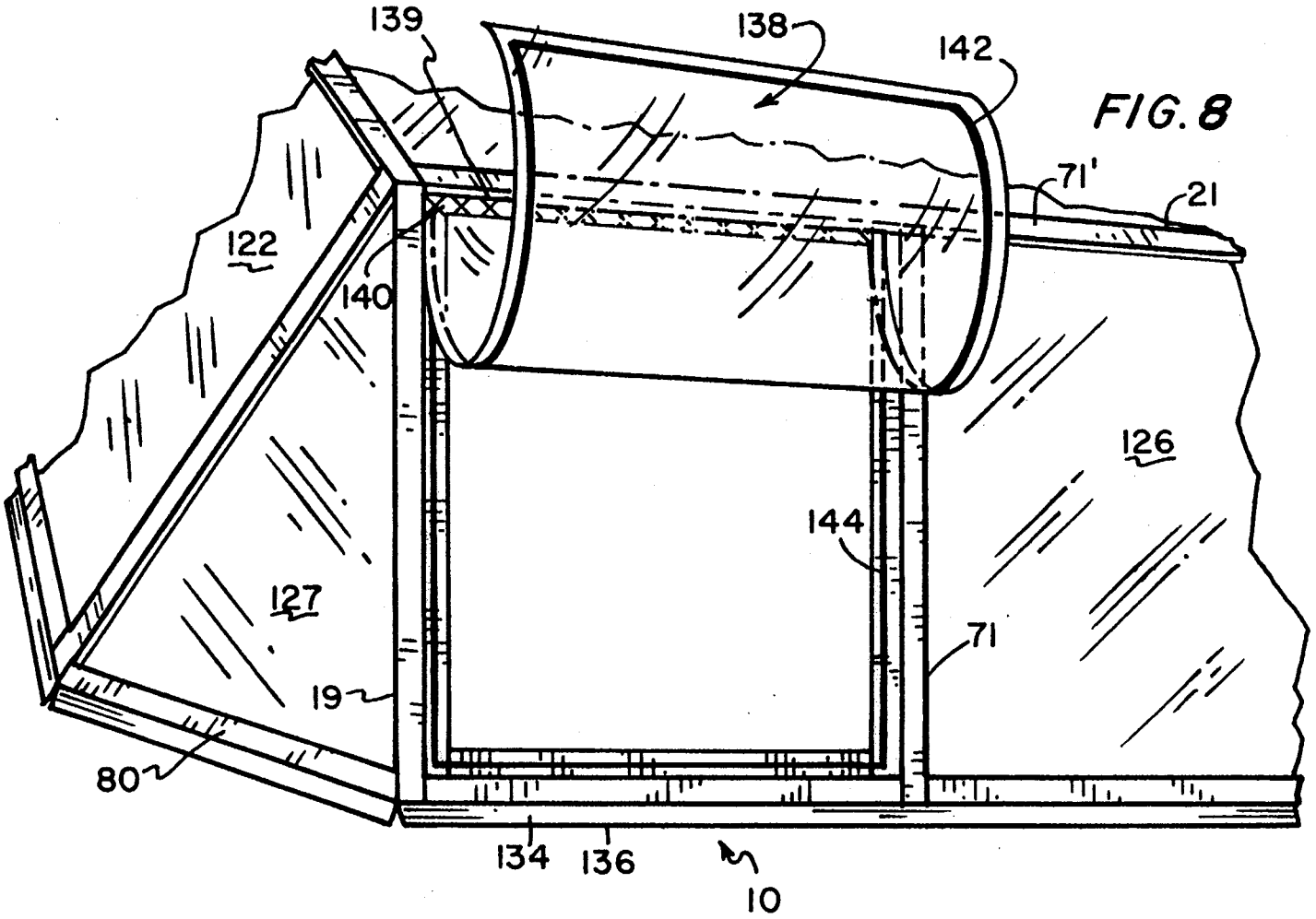
FIG. 8 is a partially cutaway perspective view of the swimming pool cover illustrating a door flap into the space enclosed.
Figure 9:
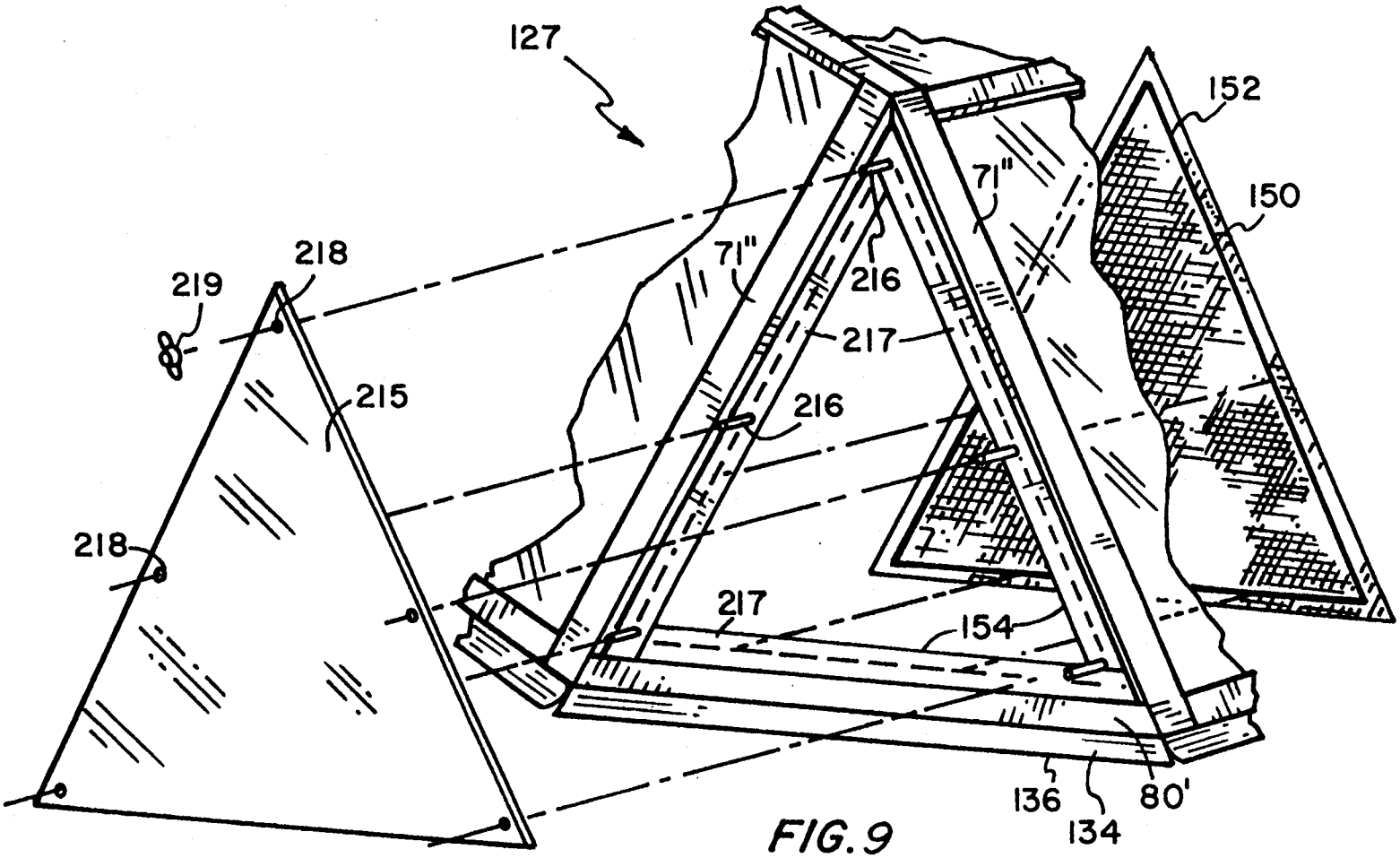
FIG. 9 is an exploded perspective view of a corner panel assembly of the swimming pool cover.

As shown in FIG. 5, a series of welting strips 134 are provided about the bottom of the swimming pool cover, attached to the bottom track members 80 on the opposite side thereof as shown in FIG. 2. The welting strips 134 are formed in lengths corresponding to the spacing between each side support and end bracket assembly, and are strips of a semi-rigid PVC or similar flexible material. Each welting strip has a round bulbous end 135 (FIG. 6A) and a flat portion 136 extending therefrom. The bulbous end 135 of welting strip 134 is received in a passage 102 or 102' (FIG. 6) of a bottom track member 80 (FIG. 2) with the flat portion of the welting extending through a slotted opening 100 or 103 of the track member. The bottom welting strip 134 is illustrated in FIGS. 5, 8, and 9. The flat portions overlap the foundation surface around the pool so that each of the welting strips 134 forms a weathertight seal at the bottom of the periphery about the pool.

As illustrated in FIG. 8, at least one flexible door flap 138 is provided in cover panel assembly 21. As shown in FIG. S, the top edge of flexible door flap 138 is sewn to a welting strip 134 forming a threaded seam 140. The welting strip 139 with seam 140 is passed through one of elongated slotted openings 100 and 103 (FIG. 7) of an end track member 72' (FIG. 8) in order to connect the flexible door flap 138 to cover panel assembly 21. The sides and the bottom of flexible door flap 138 are fitted with a hook and loop type fastener such as a VELCRO® strip 142 either glued or sewn onto the door flap. VELCRO® is attached to welting strips 144 which have been passed through the outer track passages on the sides and bottom of the door opening on the two sides and on the bottom of the opening for flexible door flap 138 so that the flexible door flap will be securely held in position when the door has been closed. It is anticipated that one flexible door flap 138 would be provided for ingress and egress into and out of the pool enclosed by swimming pool cover 10, and that a second flexible door flap 138 could be provided for access to, for example, a skimmer or the component parts of a pool filtration system located within the pool cover 10.

A corner cover panel assembly 127 is illustrated in FIG. 8. The corner cover panel assemblies are triangularly shaped and are of the same plastic material as the top and end cover panels, and are attached by VELCRO® in the same manner as door panel 138. However, VELCRO® is attached to both sides of the welting, the underside of which holds a flexible mesh screen 150 (FIG. 9). Mesh screen 150 is fastened to VELCRO® welting strips 154 and held in place by the VELCRO®.

Figure 10:
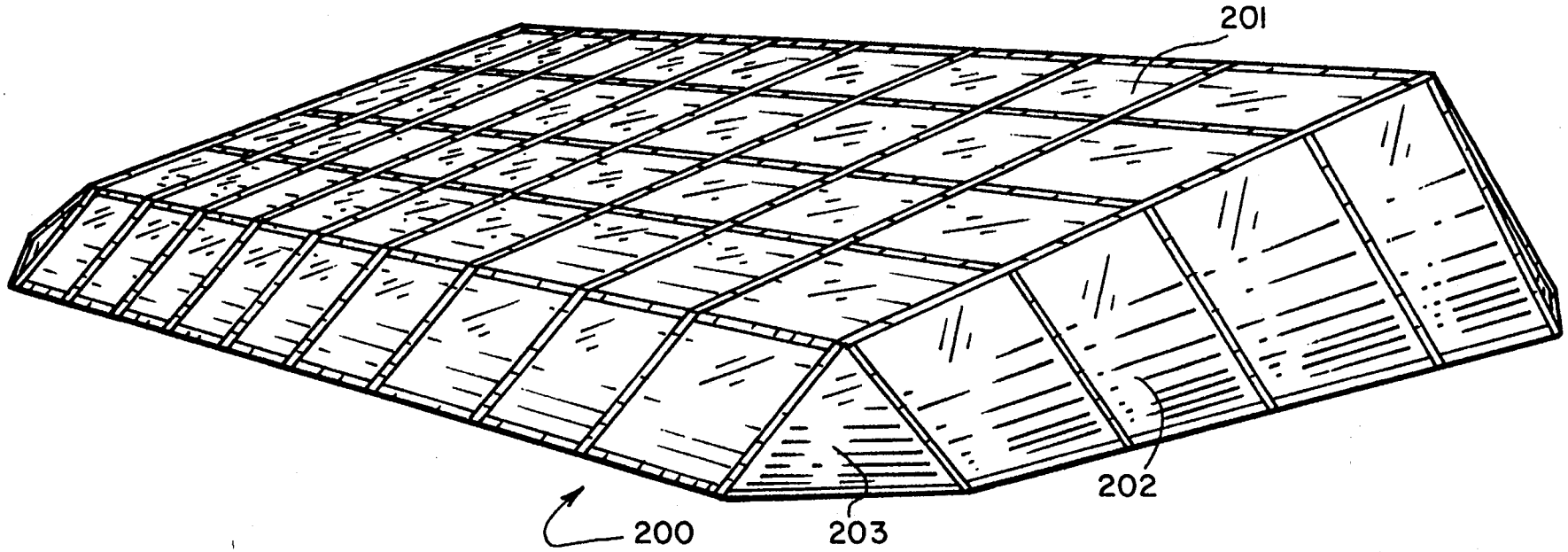
FIG. 10 illustrates an alternate embodiment of the present invention.
Figure 11:
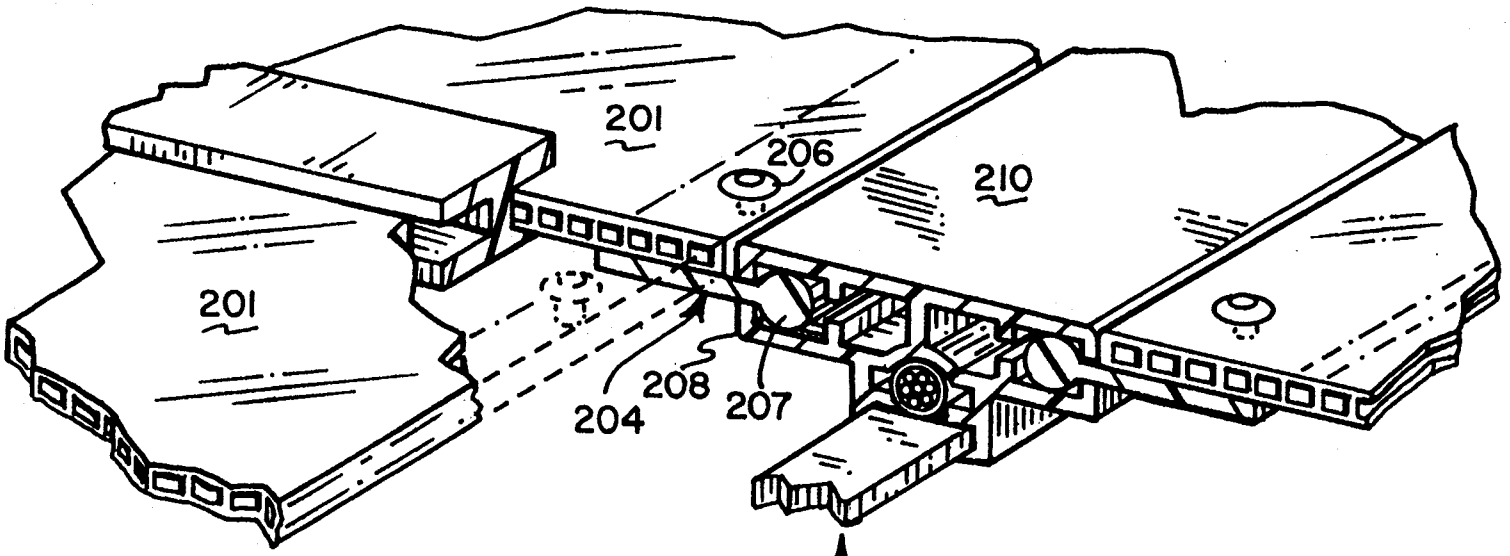
FIG. 11 is a cross-section perspective view with portions cutaway of an alternate embodiment of the cover panels of the swimming pool cover.

An alternate embodiment of cover panel assembly 200 is illustrated in FIGS. 10 and 1. This alternate embodiment includes top cover 201, end cover panels 202, and corner cover panels 203. As shown in FIG. 2, the cover panels each are fastened to an extruded PVC shape 204 along each lateral side of each sub-panel by rivets or bolts 206. The cover panels generally are formed from rigid, durable double wall polycarbonate or a similar rigid, durable material. The extruded PVC shape 204 has a bulbous end 207, a flat portion 208, and an H-shaped configuration along its opposite edge 209 into which the lateral edges of the panels are received. Top and bottom edges of the top cover panels 201 are connected by a PVC H-shape extrusion 211 into which the top and bottom edges (FIG. 1) are received. Each of top cover panels 201, end cover panels 202, and corner cover panels 203 will be constructed of a plurality of sub-panels of the same UV resistant double wall polycarbonate so that the cover will be easier to install. It is also possible that the panels can be tinted or smoked to lower the anticipated temperature build-up within pool 12 enclosed by swimming pool cover 10. As shown in FIG. 9, each corner panel assembly 203 has a rigid window 215. A plurality of threaded bolts 216 are passed through each of the three welting strips 217, and correspond in number with a series of openings 218 formed in window 215 and passing therethrough. The window 215 is placed on threaded bolts 216, and a wingnut 219 is placed on each threaded rod to secure the window to the corner cover panel assembly. When it is desired to ventilate the enclosed pool, the window can be removed to enable fresh air to circulate through pool cover 10.

INSTALLATION OF THE SWIMMING POOL COVER

The installation of swimming pool cover 10 can best be understood by referring to FIGS. 1 through 7. Once the size of the pool 12 to be enclosed by swimming pool cover 10 has been determined, the frame 19 of the swimming pool cover is assembled by erecting each of side support bracket assemblies 22 and end bracket assemblies 54 is assembled as discussed above. The number of side support bracket assemblies 22 or end bracket assemblies 54 will be determined by the length of the sides 14, 16, and the width of ends 18 of the pool 12. Guy wires 34 are attached between the leg numbers 28 and base members of the side support and end bracket assemblies for support. Each top cover panel 122, end cover panel 126, and corner panel assembly 127 will have been fabricated beforehand.

Each side support bracket assembly 22 and end bracket assembly 54 is placed in location on the periphery of pool 12. The legs 28 are unfolded from the base members and each base member is bolted into position into a concrete anchor as shown in FIGS. 2 and 5. Bracing angles 70 (FIG. 5) are then placed at the corners between the first two side support brackets on all four sides of the frame assembly. Thereafter, tube 69 is inserted into each end of the circular passages 48 (FIG. 4) defined in T-sections 40, tying each of the side support bracket assemblies together on each side of the pool. A series of support cables 64, one for each pair of side support bracket assemblies 22, is extended across the pool between each of the pairs of side support brackets. With the structural components of the frame assembly 19 (FIG. 2), support cables 64 are drawn taut by jaw and eye turnbuckles 67. Guy wires are also drawn taut by turnbuckles. Top end track members 72' are mounted on the connectors 56 (FIG. 7) of each end support bracket assembly 54 positioned along each end 18 of the pool 12.

Once frame assembly 19 (FIG. 1) has been fully constructed and is in place, it is ready to receive the top track members and cover panel assembly 21. Each of the top track members 72 of track assembly 20 is mounted on the support cables 64. As shown in FIG. 6, the track members 71 are placed upon the support cables 64 with the support cables received within the cable receiving passage 107 of the track members 71 and are slid across the pool. A slide plate 108 is then inserted into and passed along slot 109 to secure support cable 64 within the cable passage of each track member.

Cover panel assembly 21 is then placed on frame assembly 19. Each top cover panel 122 is fitted with a pulling track member (not illustrated) which has a rope or ropes attached thereto, and the pockets 130 containing tubes 132 of the side edges 123 of each top cover panel 122 are inserted into the two slotted openings 100 (FIG. 6) of two adjacent top track members 72 of the track assembly. The top cover panels are pulled, using the ropes up the high second side of the cover across the pool and down the lower first side of the cover. Once all top cover panels 122 have been so attached to the track members of the frame assembly 19, the end cover panels 126 are placed in position on frame assembly 19 by passing them through slotted openings 100 of the track members positioned along the ends of the cover. Thereafter, corner cover panel assemblies 127 are attached to frame assembly 19, as discussed in greater detail above. The first end cover panel 126 on the highest end will be replaced by a flexible doorflap 138 as shown in FIG. 8. Thereafter, a welting strip 134 is inserted into one of the channels 101 or 103 (FIG. 5) of a bottom track member 80 (FIG. 4) and the ends 124 of each top cover panel 122 and the ends of the end cover panels 126 are inserted into the other channel or one of the bottom track members.

Referring now to FIG. 2, each of bottom track members 80 is connected to foot brackets 84 of each side support bracket assembly 22 and end bracket assembly 54 in order to fasten the track assembly 20 to frame assembly 19. The welting strip abuts and lies on the surface of the foundation surrounding the pool for sealing the bottom edges of the cover.

Thus, it can be seen that the present invention comprises a useful and effective apparatus for temporarily or permanently enclosing a pool or similar area while protecting the enclosed pool, or any tools, equipment, or people housed therein. The present invention is also well suited for use as a temporary shelter or a greenhouse, as needed.

While the invention has been described with reference to preferred embodiments thereof, it will be apparent to those skilled in the art that modifications and variations can be made thereto without departing from the scope and spirit of the invention, and that the invention is to be afforded the interpretation so as to encompass all of the equivalents thereof, as set forth in the following claims.

I claim:

1. Apparatus for enclosing a swimming pool, having generally parallel longitudinal side sections, and parallel end sections defining a pool with a peripheral border, comprising:

a series of spaced supports disposed about the periphery of the pool to be covered;

a plurality of spaced support cables fastened to said supports and extending across the pool to be covered, spanning the pool and supported thereover by said supports;

means for covering the pool supported on said support cables and said supports above the pool for enclosing the pool, said means for covering comprising a series of cover panels of a size sufficient to overlap the spaces between said support cables; and a series of substantially T-shaped track assemblies each comprising a substantially rigid body having a top member, a bottom member spaced from and opposed to said top member, a substantially centrally disposed web portion connecting said top and bottom members, a series of cross pieces disposed on each side of and spaced from said web portion and defining slots therebetween within which an edge portion of a respective cover panel is received for attaching said cover panel to said track assembly, and a pair of downwardly extending legs mounted to said bottom member opposite said top member and extending away therefrom to define a cable passage in which a respective support cable is received for mounting each of said track assemblies on said support cables;

whereby said cover panels are suspended over and enclose the pool, with said cover panels attached in series to form a substantially continuous cover.

2. The apparatus of claim 1, wherein said supports each comprise:

a substantially U-shaped base member having a first and a second end;

a generally upright leg member having a first end mounted to said first end of said base member, and a second end spaced from said first end; and foot brackets connected to said second end of each base member for connecting said track assemblies to said sports.

3. Apparatus for enclosing a space having a defined peripheral border, comprising:

a plurality of supports adapted to be mounted about the peripheral border of the space and including a plurality of side support brackets positioned in opposed, spaced pairs on opposite sides of the space, and a plurality of end brackets positioned in opposed spaced pairs on opposite sides of the space, perpendicular to said side support brackets;

a plurality of spaced support cables extending across the space to be covered, spanning the space and received on and supported over the space by said supports;

said side support brackets and said end brackets each including a base member having a first end and a second end an upstanding leg member having a first end mounted to said first end of said base member and a second end paced therefrom;

a plurality of substantially T-shaped sections each having a first end mounted to within said second end of each leg member of each side support bracket and a second end supported above said second end of each leg member;

a slot formed in each of said second ends of said T-shaped sections for receiving a respective support cable;

means for covering the space supported above the space for enclosing the space, said means for covering comprising a series of cover panels of a size sufficient to overlap the spaces between said support cables; and track assemblies adapted to engage and rest upon said support cables for connecting said cover panels in series to form a substantially continuous cover supported above the surface on said support cables.

4. The apparatus of claim 2, and further comprising:

connectors each having a lower portion adapted to engage and be received in an upright position within said second ends of said leg menders, and an upper portion having a pair of spaced co-planar surfaces extending perpendicular to said lower portion along a common longitudinal plane for receiving said track assemblies.

5. The apparatus of claim 2, wherein each of said support cables comprises:

a wire cable having one end attached to said second end of one of said base members on the first side of the pool, and an opposite end of said cable is attached to said second end of said base member on the second side of the pool, with said cable extending across the pool on said supports for supporting said means for covering the pool above the pool, and a turnbuckle connected to each of said cables for adjusting the rigidity of said support cables.

6. The apparatus of claim 1 wherein said means for covering the pool further comprises:

a plurality of top, side, and end cover panels having two elongated and generally parallel side portions and two end portions;

a plurality of corner cover panels of a generally triangular shape, wherein each of said corner panels has two edge portions and a bottom portion;

a plurality of elongated welting strips for sealing the periphery of said enclosure along the end portions of each of said side and end cover panels, and along the bottom portion of said corner cover panels, respectively;

whereby said top, side, end, and corner cover panels are fastened along their common side, end, and edge portions, respectively, by said track assemblies for forming substantially continuous cover of the size needed to cover and fully enclose the top, sides, and corners of the pool.

7. The apparatus of claim 6, wherein each of said cover panels further includes:

elongated pockets formed about edge portions of said cover panels and elongated connecting members received within each of said pockets, wherein said connecting members of said cover panel are received by said track assemblies for attaching each of said cover panels to said support means.

8. The apparatus of claim 6, wherein each of said corner cover panels further comprises:

a substantially triangularly shaped screen and fastening means disposed along the edges of said screen for removably fastening said screen to said track assemblies.

9. The apparatus of claim 6 and wherein said corner cover panels each further comprise a rigid, translucent, window sized and shaped to be removably fastened to said track assemblies on the outside of said screen facing away from the pool.

10. The apparatus of claim 1, wherein said cover panels each comprise a flexible breathable plastic sheet.

11. A swimming pool cover for covering a swimming pool having spaced and generally parallel longitudinal side sections, and spaced and generally parallel end sections, comprising:

a plurality of angle brackets and end brackets spaced in opposed pairs along the sides and ends of the swimming pool, respectively;

a plurality of support cables fastened one each to each of said pairs of angle brackets and extending across the swimming pool to be covered, wherein said support cables supported at an elevation spaced above the swimming pool to be enclosed by said angle brackets;

each of said angle brackets including a generally upright leg member having a first end and a Second end positioned above the pool, and a plurality of substantially T-shaped sections having a first section mounted to said second end of each leg member and a second section having a slot formed therein for receiving a respective support cable therethrough;

a plurality of cover panels forming a substantially continuous cover above and about the swimming pool to be enclosed; and a plurality of track members adapted to receive said cover panels for attaching said cover panels to one another in series and for mounting said cover panes to said support cables and to said angle and end brackets, to form a substantially continuous enclosure.

12. The swimming pool cover of claim 11 and wherein said angle brackets and said end brackets each further comprise:

a substantially U-shaped base member having a channel within which said first end of said leg member is received and having a first end to which first end of said leg member is mounted and a second end spaced therefrom;

foot brackets connected to said second end of each base member for connecting said track means to said end and angle brackets.

13. The swimming pool cover of claim 11 and wherein said cover panels comprise:

a plurality of top, side, and end cover panels having two elongated and generally parallel side portions and two end portions;

a plurality of corner cover panels of a generally triangular shape, wherein each of said corner panels has two edge portions and a bottom portion;

a plurality of elongated welting strips for sealing the periphery of said enclosure along the end portions of each of said side and end cover panels, and along the bottom portion of said corner cover panels, respectively;

whereby said top, side, end, and corner cover panels are fastened along their common side, end, and edge portions, respectively, by said track members for forming one continuous cover of the size needed to cover and fully enclose the top, sides, and corners of the pool.

14. The swimming pool cover of claim 11 and wherein said cover panels each comprise a flexible breathable plastic sheet.

* * * * *